US005782531A

United States Patent [19]

Shindle

[11] Patent Number: 5,782,531

[45] Date of Patent: Jul. 21, 1998

[54] COMPACT BACKREST DEVICE FOR HUNTERS

[76] Inventor: Brian M. Shindle, 3211 Keating Ct., Manchester, Md. 21102

[21] Appl. No.: 831,897

[22] Filed: Apr. 3, 1997

[51] Int. Cl.[6] ..... A47C 7/02

[52] U.S. Cl. ..... 297/230.1; 297/188.04; 297/228.12

[58] Field of Search ..... 297/230.1, 4, 188.04, 297/188.01, 230.11, 230.13, 230.14, 452.48, 380, 382, 228.12, 219.1, 228.13; 5/417; 224/155, 584

[56] References Cited

U.S. PATENT DOCUMENTS

| | | | |
|---|---|---|---|
| 612,620 | 10/1898 | Devanter | 297/228.13 X |
| 954,840 | 4/1910 | Wiedemann | 5/417 X |
| 2,900,012 | 8/1959 | McGlone | 297/228.12 |
| 3,185,362 | 5/1965 | Wakefield | 297/4 X |
| 4,190,918 | 3/1980 | Harvell | 5/417 X |
| 5,110,219 | 5/1992 | Lopes | 5/417 X |
| 5,190,350 | 3/1993 | Hwang et al. | 297/380 |
| 5,386,603 | 2/1995 | Drust | 5/417 |
| 5,441,789 | 8/1995 | Walker | 297/228.12 X |
| 5,454,623 | 10/1995 | Parks | 297/4 X |
| 5,524,956 | 6/1996 | Moore | 297/4 |

*Primary Examiner*—Milton Nelson, Jr.

[57] ABSTRACT

A compact backrest device for hunters including a sheet. The sheet has a front side, a rear side and a peripheral edge. The peripheral edge has formed a first short edge, a second short edge and a pair of long edges therebetween. Included are a plurality of end straps forming a pair of first end straps and a pair of second end straps. The first pair of end straps and the second pair of end straps, each having a closure for coupling the first and second end straps when the sheet being wrapped around a tree trunk. Lastly, a plurality of padded sections are interconnected and attached to the front side of the sheet for supporting the hunter when the sheet is around the tree trunk.

5 Claims, 2 Drawing Sheets

FIG. 1
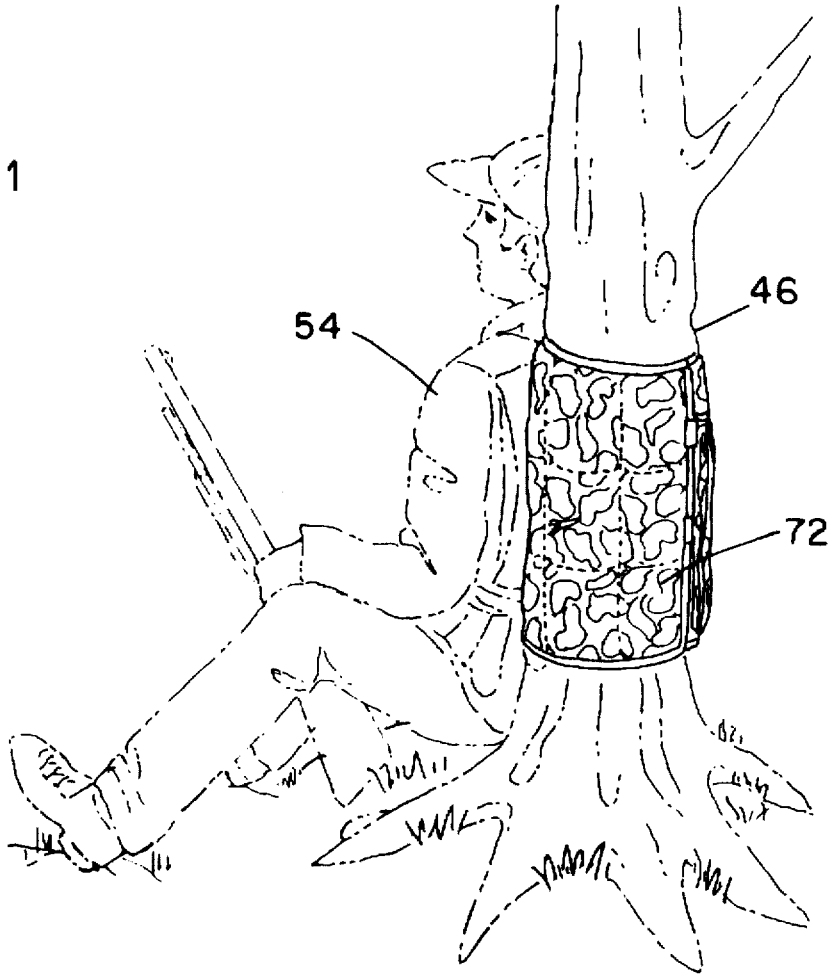
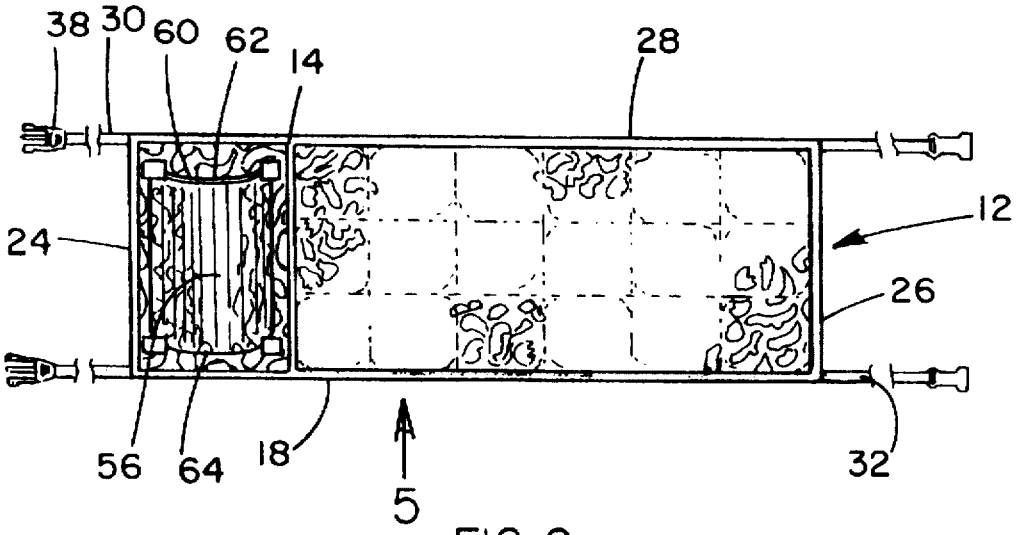
FIG. 2

COMPACT BACKREST DEVICE FOR HUNTERS

BACKGROUND OF THE INVENTION

1. Field of the Invention

The present invention relates to a compact backrest device for hunters and more particularly pertains to providing a device for wrapping around a tree trunk to give the hunter a back rest and further being padded to provide additional comfort.

2. Description of the Prior Art

The use of a tree skirt is known in the prior art. More specifically, Tree skirts heretofore devised and utilized for the purpose of wrapping around a tree trunk are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,408,782 to McConnell discloses a tree skirt. U.S. Pat. No. 5,102,265 to Dokmo, O'Brien and Lorenz discloses an adjustable width split sleeve and method for forming ends thereto. U.S. Pat. No. 4,658,452 to Brockhaus discloses a sportsman's pad. U.S. Pat. No. 4,488,620 to Gibson discloses a climbing apparatus. Lastly, U.S. Pat. No. 4,474,265 to Shinkle discloses a tree chair.

In this respect, the compact backrest device for hunters according to the present invention substantially departs from the conventional concepts and designs of the prior art, and in so doing provides an apparatus primarily developed for the purpose of providing a device for wrapping around a tree trunk to give the hunter a back rest and further being padded to provide additional comfort.

Therefore, it can be appreciated that there exists a continuing need for a new and improved compact backrest device for hunters which can be used for providing a device for wrapping around a tree trunk to give the hunter a back rest and further being padded to provide additional comfort. In this regard, the present invention substantially fulfills this need.

SUMMARY OF THE INVENTION

In view of the foregoing disadvantages inherent in the known types of Tree skirts now present in the prior art, the present invention provides an improved compact backrest device for hunters. As such, the general purpose of the present invention, which will be described subsequently in greater detail, is to provide a new and improved compact backrest device for hunters which has all the advantages of the prior art and none of the disadvantages.

To attain this, the present invention essentially comprises a generally rectangular sheet having a front side, a rear side and a peripheral edge. The peripheral edge has formed a first short edge, a second short edge and a pair of long edges therebetween. A plurality of end straps are included and form a pair of first end straps and a pair of second end straps. The pair of first end straps are each fixedly attached to the first short edge of the sheet. Each of the pair of first end straps have a free end with a male adjustable coupled thereto. The pair of second end straps each are fixedly attached to the second short edge of the sheet. Each of the pair of second end straps have a free end with a female adjustable coupled thereto. The male adjustable is coupled with the female adjustable when the sheet is wrapped around a tree trunk. The rear side is adjacent the tree trunk when the sheet is wrapped around the trunk. Included is a carrying strap that is fixedly attached to the rear side of the sheet. The carrying strap is spaced from the first short end edge. The carrying strap will support the sheet over a hunters shoulder when the sheet is in a roll. A quiver is fixedly attached to the front side of the sheet. The quiver has an upper end edge defining an upper opening and a lower end edge defining a lower opening. Lastly, a plurality of padded sections are interconnected and attached to the front side of the sheet. The padded sections are spaced from the second short edge. The padded sections have a water repellent covering. The padded sections will support the hunters back when the sheet is wrapped around the tree trunk.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved compact backrest device for hunters which has all the advantages of the prior art tree skirts and none of the disadvantages.

It is another object of the present invention to provide a new and improved compact backrest device for hunters which may be easily and efficiently manufactured and marketed.

It is a further object of the present invention to provide a new and improved compact backrest device for hunters which is of a durable and reliable construction.

An even further object of the present invention is to provide a new and improved compact backrest device for hunters which is susceptible of a low cost of manufacture with regard to both materials and labor, and which accordingly is then susceptible of low prices of sale to the consuming public, thereby making such compact backrest device for hunters economically available to the buying public.

Still yet another object of the present invention is to provide a new and improved compact backrest device for hunters which provides in the apparatuses and methods of the prior art some of the advantages thereof, while simultaneously overcoming some of the disadvantages normally associated therewith.

Still another object of the present invention is to providing a device for wrapping around a tree trunk to give the hunter a back rest and further being padded to provide additional comfort.

Lastly, it is an object of the present invention to provide a new and improved compact backrest device for hunters including a sheet. The sheet has a front side, a rear side and a peripheral edge. The peripheral edge has formed a first short edge, a second short edge and a pair of long edges therebetween. Included are a plurality of end straps forming a pair of first end straps and a pair of second end straps. The first pair of end straps and the second pair of end straps, each having a closure means for coupling the first and second end straps when the sheet being wrapped around a tree trunk. Lastly, a plurality of padded sections are interconnected and attached to the front side of the sheet for supporting the hunter when the sheet is around the tree trunk.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of the preferred embodiment of the compact backrest device for hunters constructed in accordance with the principles of the present invention.

FIG. 2 is a top plan view of the sheet in an expanded orientation.

Similar reference characters refer to similar parts throughout the several views of the drawings.

DESCRIPTION OF THE PREFERRED EMBODIMENT

Figure 3:
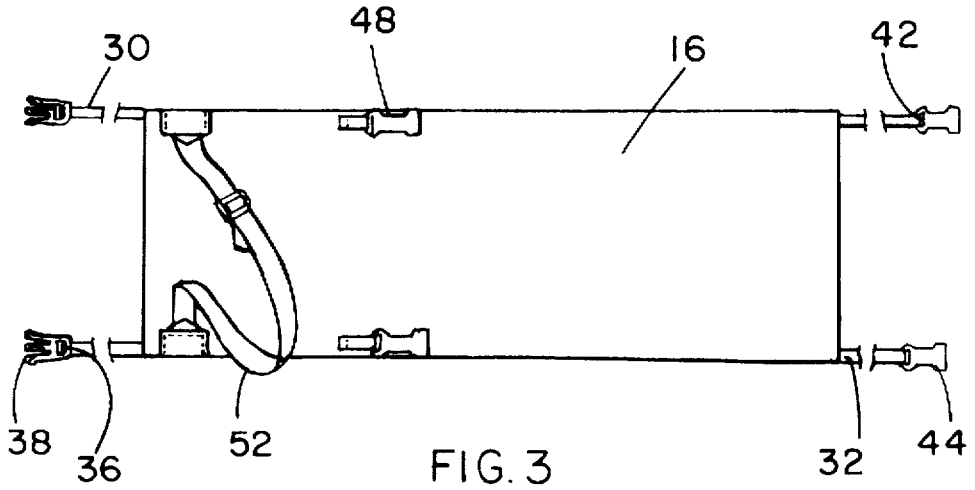
FIG. 3 is a rear plan view of the sheet in an expanded orientation.

With reference now to the drawings, and in particular to FIG. 1 thereof, a new and improved compact backrest device for hunters embodying the principles and concepts of the present invention and generally designated by the reference numeral 10 will be described.

The present invention, the new and improved compact backrest device for hunters, is comprised of a plurality of components. Such components in their broadest context include a sheet, straps, padding and closure means. Such components are individually configured and correlated with respect to each other so as to attain the desired objective.

Figure 5:
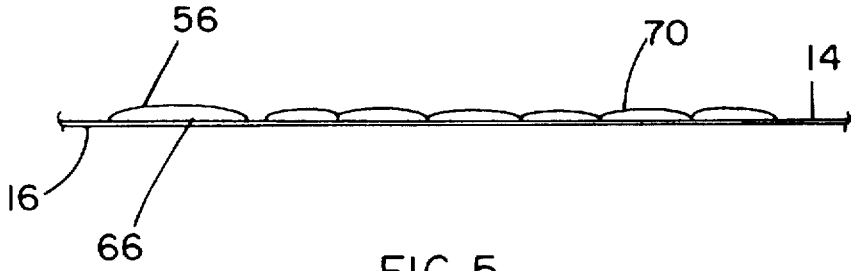
FIG. 5 is side elevational view of the sheet in an expanded orientation.

More specifically, it will be noted that the present invention is comprised of a generally rectangular sheet 12. As shown in FIG. 5, the sheet has a front side 14, a rear side 16 and a peripheral edge 18 therearound. The peripheral edge forms a first short edge 24, a second short edge 26 and a pair of long edges 28 therebetween.

Included are a plurality of end straps forming a pair of first end straps 30 and a pair of second end straps 32. FIG. 3 shows that the pair of first end straps are each fixedly attached to the first short edge 24 of the sheet. Each of the pair of first end straps has a free end 36 with a male adjustable member 38 coupled thereto. As shown in FIG. 3, the pair of second end straps are each fixedly attached to the second short edge 26 of the sheet. Each of the pair of second end straps has a free end 42 with a female adjustable member 44 coupled thereto. The male adjustable member is coupled with the female adjustable member when the sheet is wrapped around a tree trunk 46, as depicted in FIG. 1. The rear side is adjacent the tree trunk when the sheet is coupled around the trunk.

Figure 4:
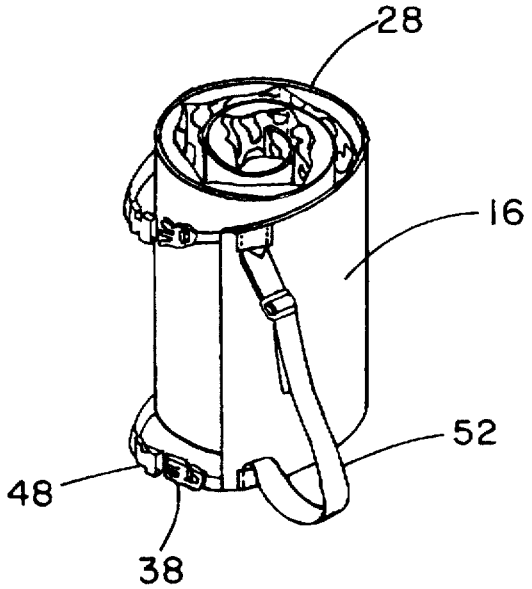
FIG. 4 is an isometric view of the sheet in a rolled orientation.

As illustrated in FIG. 3, a pair of rear female adjustables member 48 are included. Each rear female adjustable member are fixedly attached to the rear side 16 of the sheet. As shown in FIG. 4, the male adjustable member will couple with the rear female adjustable member when the sheet is rolled for storage.

Spaced from the rear female adjustable member is a carrying strap 52. The carrying strap is fixedly attached to the rear side 16 of the sheet and spaced from the first short end edge. The carrying strap is adjustable and will support the sheet over a hunter's 54 shoulder when the sheet is in a roll.

Also, a quiver 56 is fixedly attached to the front side of the sheet, as seen in FIG. 2. The quiver has an upper end edge 60 defining an upper opening 62 and a lower end edge 64 defining a lower opening 66. The quiver is used to carry arrows or riffles.

Lastly, a plurality of padded sections 70 are included. As shown in FIG. 5, the padded sections are interconnected and attached to the front side 14 of the sheet. The padded sections are spaced from the second short edge 26 and the quiver 56. The padded sections have a water repellent covering 72 that has camouflage patter. The padded sections will support the hunters back when the sheet is wrapped around the tree trunk.

The present invention compact backrest device for hunters is designed to provide a convenient and comfortable back rest for hunters. The present invention is lightweight and rolls up into a compact bundle for easy carrying. The present invention, when unrolled, can be secured around a tree trunk to provide a comfortable back support when the hunter is sitting on the ground or in a tree stand. The device includes firm padding between the front side and the rear side. The padding and the front side are each covered with camouflage/water repellent material. A plurality of adjustable length straps are included. Straps are extended from each short end edge to couple with each other for securing the device around the tree trunk. Also, a third set of closure means are provided so as to secure the sheet when in the rolled orientation. Finally, a quiver is attached to the front side to support arrows or riffles that are being used by the hunter.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved compact backrest device for hunters comprising in combination:

a generally rectangular sheet having a front side, a rear side and a peripheral edge therearound, the peripheral edge of the sheet having formed a first short edge, a second short edge and a pair of long edges therebetween;

a plurality of end straps forming a pair of first end straps and a pair of second end straps, the pair of first end straps each being fixedly attached to the first short edge of the sheet, each of the pair of first end straps having a free end with a male adjustable member coupled thereto, the pair of second end straps each being fixedly attached to the second short edge of the sheet, each of the pair of second end straps having a free end with a female adjustable member coupled thereto, the male adjustable member being coupled with the female adjustable member when the sheet is wrapped around a tree trunk and the rear side is placed adjacent the tree trunk;

a carrying strap being fixedly attached to the rear side of the sheet and spaced from the first short edge, the sheet being placed in a roll for allowing the carrying strap to support the sheet over a hunters shoulder;

a quiver being fixedly attached to the front side of the sheet, the quiver having an upper end edge defining an upper opening and a lower end edge defining a lower opening; and a plurality of padded sections being interconnected and attached to the front side of the sheet, the padded sections being spaced from the second short edge, the padded sections having a water repellent covering thereon, the padded sections support the hunter's back when the sheet is releasably coupled around the tree trunk.

2. A compact backrest device for hunters comprising:

a sheet having a front side, a rear side and a peripheral edge therearound, the peripheral edge having formed a first short edge, a second short edge and a pair of long edges therebetween, the rear side of the sheet having a pair of rear female adjustable members fixedly attached thereto;

a plurality of end straps forming a pair of first end straps and a pair of second end straps, the first pair of end straps and the second pair of end straps each having a closure means for coupling the first and second end straps when the sheet is releasably wrapped around a tree trunk, the pair of first end straps each being fixedly attached to the first short edge of the sheet and having a free end, the closure means of the pair of first end straps being a male adjustable member coupled to the free end of each of the pair of first end straps, the pair of second end straps each being fixedly attached to the second short edge of the sheet and having a free end, the closure means of the pair of second end straps being a female adjustable member coupled to the free end of each of the pair of second end straps; and a plurality of padded sections being interconnected and attached to the front side of the sheet for supporting the hunter when the sheet is around the tree trunk;

3. The compact backrest device for hunters as set forth in claim 2, wherein a carrying strap is fixedly attached to the rear side of the sheet, the carrying strap being spaced from the first short edge and the pair of rear female adjustable members, the sheet being rolled for allowing the carrying strap to support the sheet over a hunters shoulder.

4. The compact backrest device for hunters as set forth in claim 2 further including a quiver being fixedly attached to the front side of the sheet, and the quiver having an upper end edge defining an upper opening and a lower end edge defining a lower opening.

5. The compact backrest device for hunters as set forth in claim 2, wherein the padded sections are spaced from the second short edge, the padded sections having a water repellent covering thereon, and the padded sections support the hunters back when the sheet is releasably coupled around the tree trunk.

* * * * *